US008200144B2

(12) United States Patent
Yamazaki et al.

(10) Patent No.: US 8,200,144 B2
(45) Date of Patent: Jun. 12, 2012

(54) IMAGE FORMING APPARATUS AND IMAGE FORMING METHOD

(75) Inventors: Michio Yamazaki, Ebina (JP); Tomonari Sakurai, Saitama (JP); Tsutomu Mori, Ebina (JP); Yoshinori Nishizawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1037 days.

(21) Appl. No.: 12/136,293

(22) Filed: Jun. 10, 2008

(65) Prior Publication Data

US 2009/0129839 A1 May 21, 2009

(30) Foreign Application Priority Data

Nov. 16, 2007 (JP) ..... 2007-297490

(51) Int. Cl.
*G03G 15/00* (2006.01)

(52) U.S. Cl. ..... 399/405; 399/400; 399/401; 399/406

(58) Field of Classification Search ..... 399/400, 399/401, 405, 406
See application file for complete search history.

(56) References Cited

U.S. PATENT DOCUMENTS

| | | | | |
|---|---|---|---|---|
| 5,517,281 | A | 5/1996 | Miyashiro et al. | |
| 6,619,657 | B2 * | 9/2003 | Horikoshi et al. | 271/188 |
| 2005/0158066 | A1 * | 7/2005 | Tomiyori et al. | 399/68 |
| 2007/0052151 | A1 * | 3/2007 | Asaba | 271/10.01 |

FOREIGN PATENT DOCUMENTS

| | | | |
|---|---|---|---|
| JP | 04-286453 | A | 10/1992 |
| JP | 5-150572 | A | 6/1993 |
| JP | 09-006163 | A | 1/1997 |
| JP | 2001-089040 | A | 4/2001 |
| JP | 2002-251044 | A | 9/2002 |

OTHER PUBLICATIONS

Translation of Japanese Office Action dated Mar. 16, 2010 for Japanese Patent Application No. 2007-297490.

Japanese Office Action dated Oct. 5, 2010 for Japanese Application No. 2007-297490.

* cited by examiner

*Primary Examiner* — Judy Nguyen

*Assistant Examiner* — Andy Pham

(74) *Attorney, Agent, or Firm* — Sughrue Mion, PLLC

(57) ABSTRACT

The image forming apparatus is provided with: a carrier that carries a toner image; a transporting unit that transports a sheet with using a transporting route; a transfer unit that transfers the toner image carried by the carrier to the sheet transported by the transporting unit; a fixing unit that fixes the toner image transferred by the transfer unit on the sheet; and an exit opening that is disposed so that a transfer position of the transfer unit is located between the exit opening and a fixation position of the fixing unit in a section including a transporting route over the entire length and that discharges the sheet on which the toner image is fixed by the fixing unit to an outside of the apparatus.

11 Claims, 15 Drawing Sheets

IMAGE FORMING APPARATUS AND IMAGE FORMING METHOD

CROSS REFERENCE TO RELATED APPLICATIONS

This application is based on and claims priority under 35 USC §119 from Japanese Patent Application No. 2007-297490 filed Nov. 16, 2007.

BACKGROUND

1. Technical Field

The present invention relates to an image forming apparatus and an image forming method.

2. Related Art

A technology that addresses defect caused by keeping the heat of transfer materials discharged from a thermal fixation apparatus of an image forming apparatus has been proposed.

SUMMARY

According to an aspect of the invention, there is provided an image forming apparatus including: a carrier that carries a toner image; a transporting unit that transports a sheet with using a transporting route; a transfer unit that transfers the toner image carried by the carrier to the sheet transported by the transporting unit; a fixing unit that fixes the toner image transferred by the transfer unit on the sheet; and an exit opening that is disposed so that a transfer position of the transfer unit is located between the exit opening and a fixation position of the fixing unit in a section including a transporting route over the entire length and that discharges the sheet on which the toner image is fixed by the fixing unit to an outside of the apparatus.

BRIEF DESCRIPTION OF THE DRAWINGS

Exemplary embodiment (s) of the present invention will be described in detail based on the following figures, wherein.

DETAILED DESCRIPTION

Exemplary embodiments of the present invention will be described below in detail with reference to the attached drawings.

[First Exemplary Embodiment]

Figure 1:
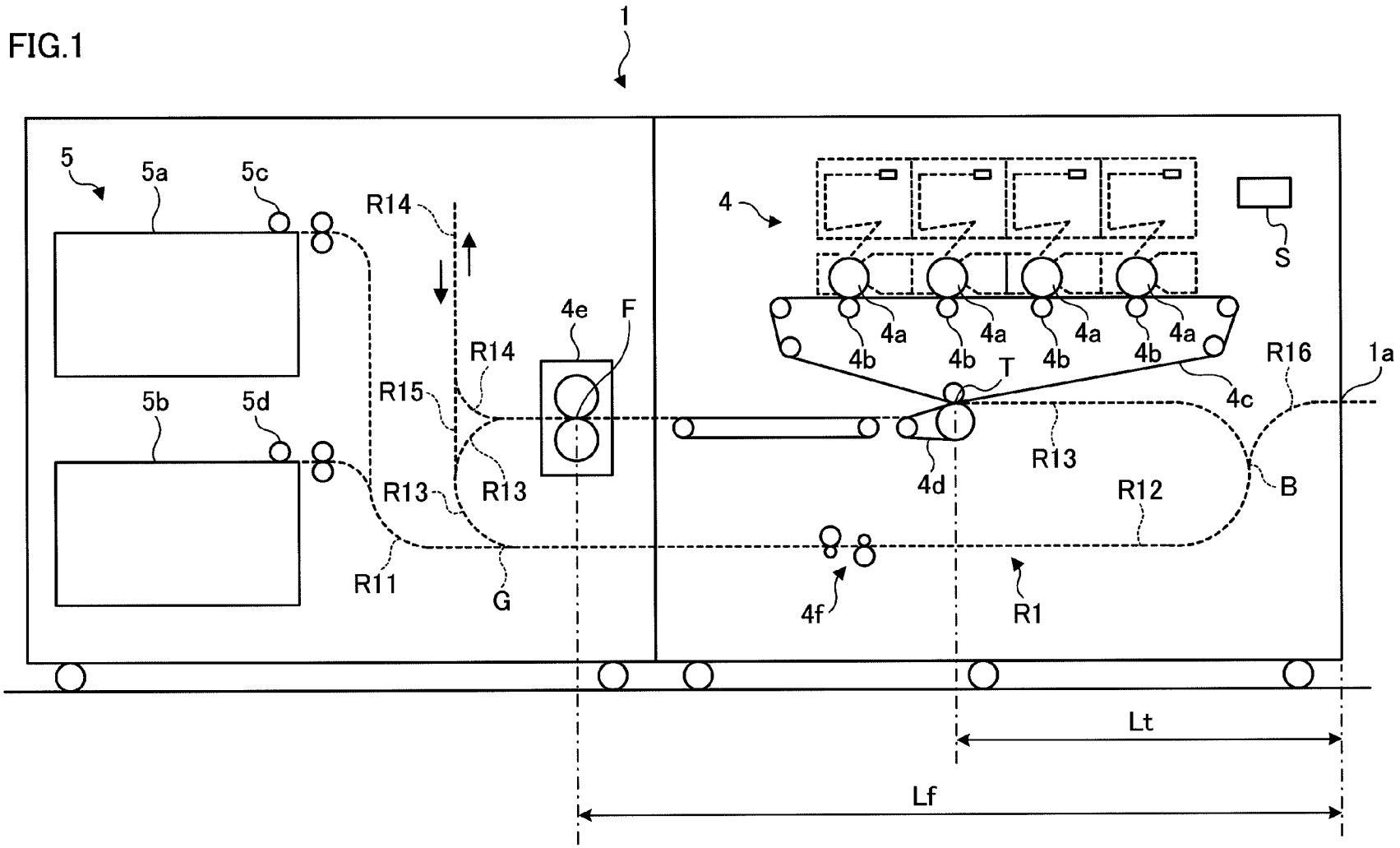
FIG. 1 is a schematic configuration diagram illustrating the entire configuration of an image forming apparatus according to a first exemplary embodiment.

FIG. 1 is a schematic configuration diagram illustrating the entire configuration of an image forming apparatus 1 according to a first exemplary embodiment. FIG. 1 shows the configuration in a section including a transporting route (transporting unit) R1 that transports various types of sheets over the entire length. From another point of view, FIG. 1 shows the configuration of the transporting route R1 that transports various types of sheets, which is seen from a transverse direction.

The image forming apparatus 1 shown in FIG. 1 includes an image forming unit 4 that forms an image on a sheet (a recording medium) which is not shown in the figure, upon a print instruction from a personal computer (not shown in the figure), a sheet supplying unit 5 that supplies various types of sheets including thick paper to the image forming unit 4, and a controller S that controls operation and the like of each unit (each portion).

The image forming unit 4 is a so-called four-consecutive tandem-type configuration having four photoconductor drums (carriers) 4*a* arranged in parallel in the horizontal direction corresponding to each color of black (K), yellow (Y), magenta (M), and cyan (C), and four primary transfer rolls 4*b* disposed corresponding one of the photoconductor drums 4*a*. In addition, the image forming unit 4 has an intermediate transfer belt 4*c* on which a toner image formed on each of the photoconductor drums 4*a* is sequentially and primarily transferred, a secondary transfer belt (transfer unit) 4*d* that conducts secondary transfer in which the superposed toner image on the intermediate transfer belt 4*c* is secondarily transferred on a sheet, and a fixing device (a fixing unit) 4*e* that fixes the toner image on the sheet after the secondary transfer.

Here, around each of the photoconductor drums 4*a*, a charging device that uniformly charges the surface of the photoconductor drum 4*a*, and a laser writing device that forms an electrostatic latent image by laser irradiation on the surface of the photoconductor drum 4*a* charged by the charging device are arranged. Moreover, around each of the photoconductor drums 4*a*, a developing device that develops the electrostatic latent image formed on the photoconductor drum 4*a* with a predetermined color component toner and visualizes it, and a cleaner that removes the remaining toner remaining on the surface of the photoconductor drum 4*a* after the primary transfer are arranged.

On the other hand, respective primary transfer rolls 4*b* are arranged so as to be opposed to the vicinity of the corresponding photoconductor drums 4*a*, while the intermediate transfer belt 4*c* is sandwiched in between. These primary transfer rolls 4*b* conduct the primary transfer in which the toner images formed on the corresponding photoconductor drums 4*a* are sequentially transferred on the intermediate transfer belt 4*c*. The intermediate transfer belt 4*c* is stretched in a loop state by plural supporting rolls.

The secondary transfer belt 4*d* is disposed so as to be opposed to the intermediate transfer belt 4*c*, and is stretched by a driving roll and a driven roll. The secondary transfer belt 4*d* conducts the secondary transfer (the collective transfer) in which the superposed toner image of respective colors sequentially primary-transferred on the intermediate transfer belt 4*c* is secondarily transferred on a sheet, and this secondary transfer position (transfer position) T becomes a position for image forming processing in the image forming unit 4.

The fixing device 4*e* fixes the toner image on the sheet with heat, pressure and the like. The fixing device 4*e* is provided with a heat roll incorporating a heater such as a halogen lamp, and a presser roll brought into contact with the heat roll with pressure. The heater is controlled so that the surface of the heat roll is maintained at a predetermined surface temperature.

On the other hand, the sheet supplying unit 5 transports an A4-sized sheet (not shown in the figure) contained in a container tray 5*a* and a sheet of thick paper (not shown in the figure) contained in a container tray 5*b*, through predetermined routes respectively. In the vicinity of each of the container trays 5*a* and 5*b*, corresponding feeding rolls 5*c* and 5*d* are disposed, respectively. Each of the feeding rolls 5*c* and 5*d* is configured to operate upon instructions of the controller S. Each of the feeding rolls 5*c* and 5*d* nips and temporarily stops various types of sheets separated one by one and taken out from the corresponding container trays 5*a* and 5*b* and feeds out each of the various types of sheets to the transporting route R1 at predetermined timing based on a start signal from the controller S. The sheet is discharged outside the apparatus at an exit opening 1*a*.

Here, the transporting route R1 will be described below.

The transporting route R1 is provided with a transporting section R11 that transports each of the various types of sheets taken out from the container trays 5*a* and 5*b* to a junction point G, a transporting section R12 that transports each of the various types of sheets from the junction point G to a branch point B, and a transporting section R13 that transports each of the various types of sheets from the branch point B to the junction point G through the secondary transfer position T and a fixation position F.

The transporting route R1 is also provided with transporting sections R14 and R15 that bypass a predetermined section between the fixation position F and the junction point G in the transporting section R13, and a transporting section R16 that transports each of the various types of sheets from the branch point B to the exit opening 1*a* of the image forming apparatus 1.

In more detail, the transporting sections R14 and R15 are provided in order to reverse each of the various types of sheets during the transportation. That is, when each of the various types of sheets transported in the transporting section R13 is fed into the transporting section R14, the transportation is stopped once. Each of the various types of sheets is then, transported in a direction opposite to the direction where the sheet has been transported and is returned from the transporting section R15 to a position just before the junction point G of the transporting section R13. When the sheet is fed into the transporting section R13 from the transporting section R12 through the branch point B in that state, transfer and fixation is conducted on a surface on which transfer and fixation has not been conducted yet. On the other hand, when the sheet is fed into the transporting section R16 through the branch point B, the sheet is discharged from the exit opening 1*a* with the printed surface upward. The sheet discharged from the exit opening 1*a* is stacked on an output tray (not shown in the figure).

The junction point G is a downstream end of the transporting section R11, and is also an upstream end of the transporting section R12 and a downstream end of the transporting section R13. The branch point B is a downstream end of the transporting section R12, and is also an upstream end of the transporting section R13 and an upstream end of the transporting section R16.

The transporting sections R12 and R13 are connected to each other at the junction point G and the branch point B. That is, a circulation transporting route is constituted by the transporting sections R12 and R13. Thus, the sheet may be transported so as to be circulated in the transporting sections R12 and R13. Similarly, the sheet maybe transported so as to be circulated in the transporting sections R12, R13, R14 and R15 while transported so as to be reversed alternatively. The junction point G and the branch point B are configured so that the sheet transported from the upstream is selectively fed into the downstream.

In the transporting section R12, a curl correcting portion (a correction portion) 4*f* that corrects curling of the sheets caused upon fixation by the fixing device 4*e* is provided. In a series of the transporting sections R11 to R16 from the sheet feeding position by each of the feeding rolls 5*c* and 5*d* to the exit opening 1*a* via the image forming processing position in the image forming unit 4, transporting rolls (not shown in the figure) for transporting the sheet are disposed as appropriate, respectively.

With respect to the transporting route R1 as above, a relative positional relation among the secondary transfer position T, the fixation position F, and the exit opening 1*a* may be viewed as follows. That is, the transporting route R1 is configured so that the secondary transfer position T is located between the fixation position F and the exit opening 1*a*. In other words, the transporting route R1 is configured so that the distance Lf between the fixation position F and the exit opening 1*a* is longer than the distance Lt between the secondary transfer position T and the exit opening 1*a*. To put it another way, the transporting route R1 has a configuration in which each of the various types of sheets is transported so as to be moved away from the exit opening 1*a* and pass the fixation position F after the transfer at the secondary transfer position T. Such a relative positional relation is also applied to a transporting route R2 (refer to FIG. 8) and a transporting route R3 (refer to FIG. 12), which will be described later.

Further, the transporting route R1 may be considered to be configured so that the fixation position F is located between the container trays 5*a* and 5*b* and the secondary transfer position T as the relative positional relation among the container trays 5*a* and 5*b* and the secondary transfer position T. Such a relative positional relation is also applied to the transporting route R2 (refer to FIG. 8), which will be described later.

An operation of the image forming apparatus 1 will be described.

When image data outputted from an image reading apparatus (not shown in the figure), or an information processing apparatus (not shown in the figure), are inputted into the image forming apparatus 1, a toner image is formed in the image forming unit 4 based on the image data.

In the image forming unit 4, while the four photoconductor drums 4*a* are rotated and driven, toner images of black, yellow, magenta, and cyan are formed on the surfaces of the photoconductor drums 4*a* by corresponding charging devices, laser writing devices, and developing devices, respectively. The respective color toner images formed as above are sequentially superposed and transferred onto the intermediate transfer belt 4*c* by the primary transfer rolls 4*b*. As a result, on the intermediate transfer belt 4*c*, a multi-color (full-color) toner image in which the toner images in four colors are superposed is formed. Further, the toner image formed on the intermediate transfer belt 4*c* is fed into the secondary transfer position T while being held on the intermediate transfer belt 4*c*.

On the other hand, the sheet on the selected container tray 5*a* or the container tray 5*b* is transported along the transporting route R1 and fed according to the timing when the toner image on the intermediate transfer belt 4*c* reaches the secondary transfer position T. At the secondary transfer position T, the toner image (full-color image) held on the intermediate transfer belt 4*c* is collectively transferred (secondarily transferred) to the sheet by the secondary transfer belt 4*d*. After that, the sheet on which the toner image has been transferred is fed to the fixing device 4*e* and given fixation with heat and pressure, and then, for example, transported to the exit opening 1*a*, subjected to reverse processing and transported to the exit opening 1*a*, or subjected to the print processing for the back surface and transferred to the exit opening 1*a*.

(Regular Discharge)

Figure 2:
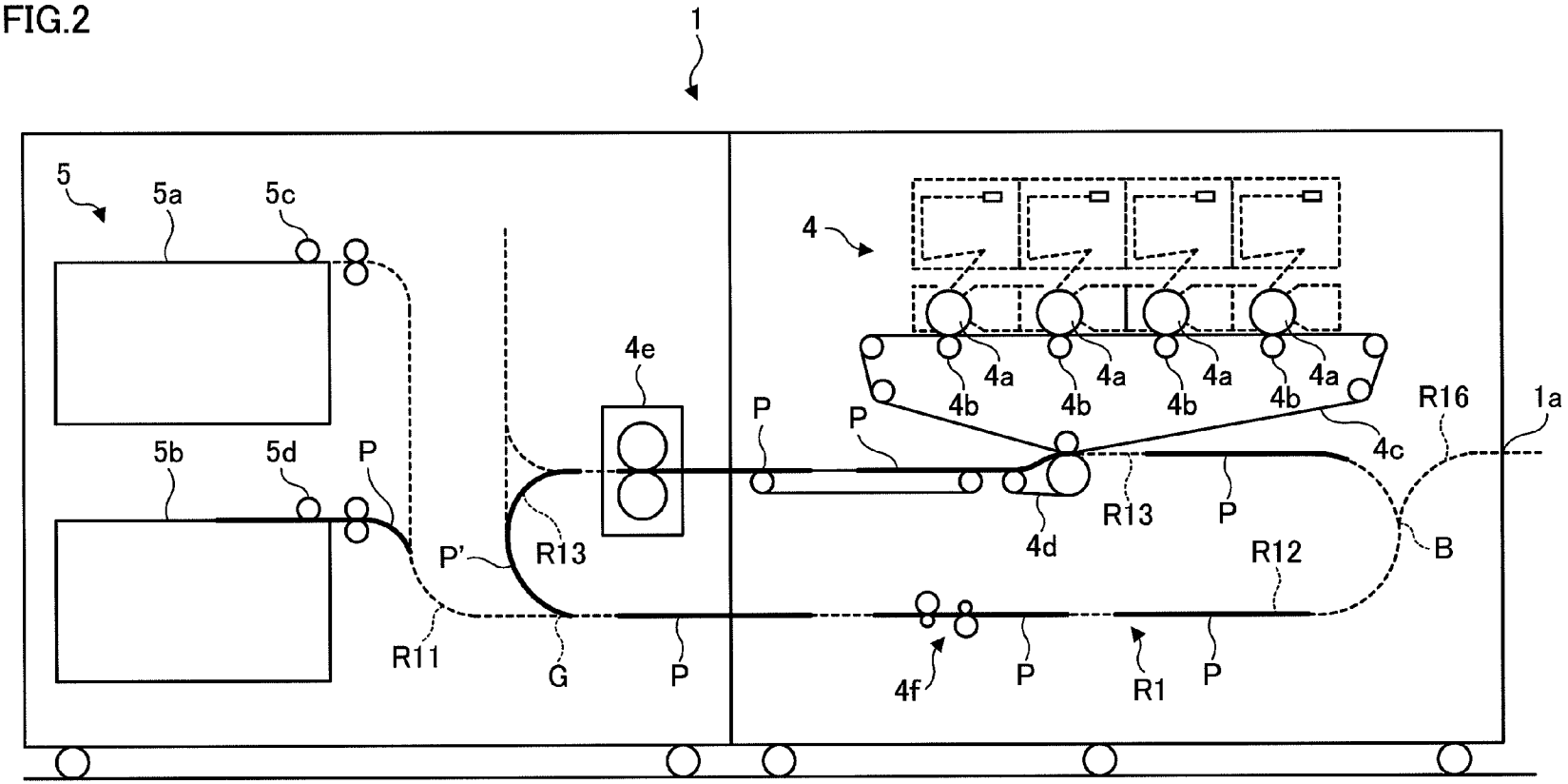
FIG. 2 is a diagram for explaining the sheet transportation in the transporting route in the case of one-sided printing.
Figure 3:
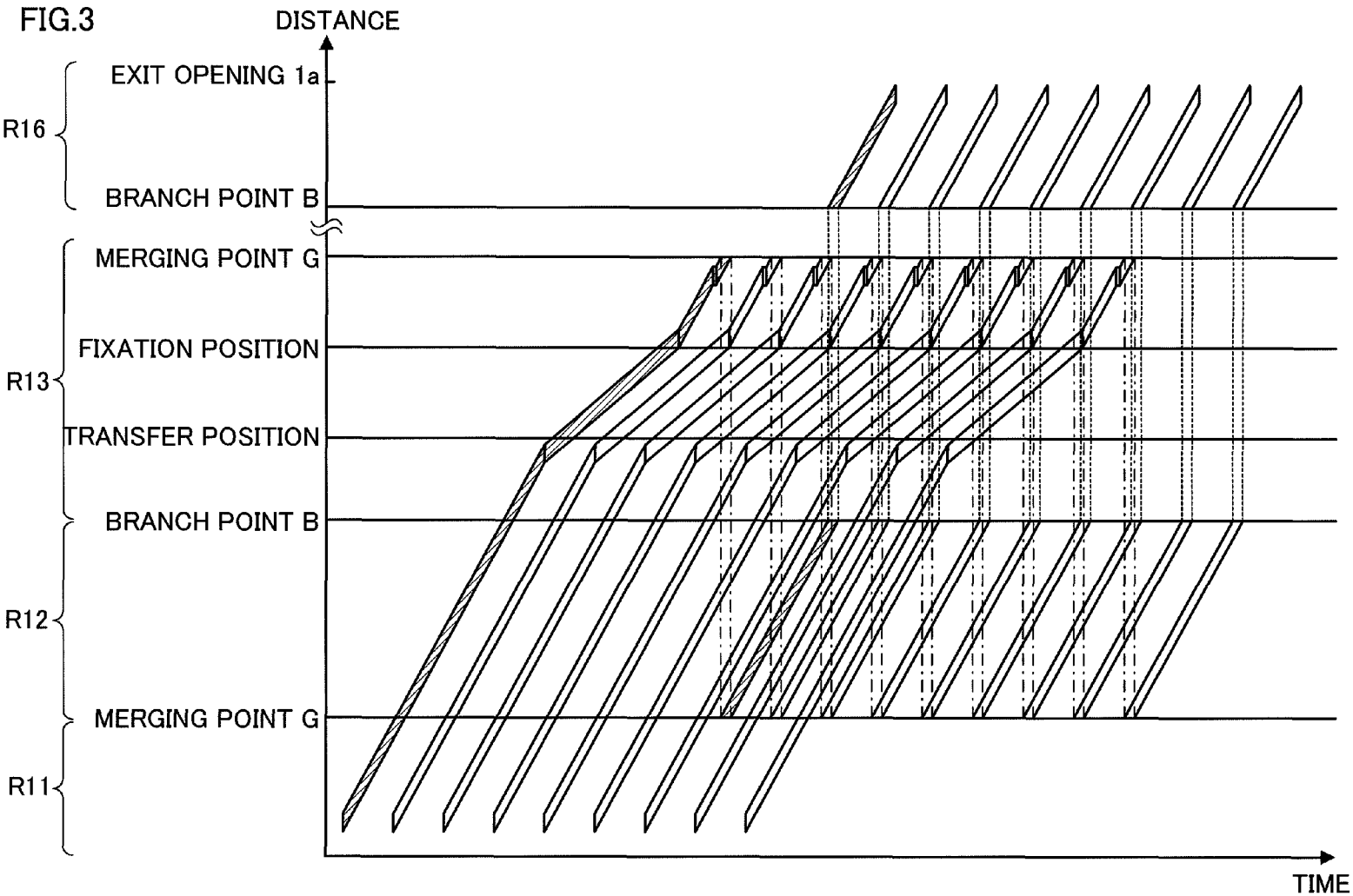
FIG. 3 is a time-chart of the sheet transportation in the transporting route in FIG. 2.

FIG. 2 is a diagram for explaining the sheet transportation in the transporting route R1 in the case of one-sided printing, and FIG. 3 is a time-chart of the sheet transportation in the transporting route R1 in FIG. 2.

When a print instruction of the one-sided printing is given and the container tray 5*b* is selected, as shown in FIG. 2, a supplied sheet P fed out of the container tray 5*b* to the transporting section R11 by the feeding roll 5*d* is transported to the transporting section R13 through the junction point G, the transporting section R12 and the branch point B. In the transporting section R13, the toner image is transferred to the supplied sheet P at the secondary transfer position T (refer to FIG. 1) and the toner image is fixed at the fixation position F (refer to FIG. 1). A printed sheet P' having passed the fixation position F is transported from the transporting section R13 to the transporting section R12 via the junction point G, and then, transported to the transporting section R16 via the branch point B and discharged out of the apparatus from the exit opening 1*a*.

To the transporting section R12, the supplied sheet P from the transporting section R11 is transported and the printed sheet P' from the transporting section R13 is also transported. Therefore, the transportation of the supplied sheet P from the transporting section R11 via the junction point G to the transporting section R12 needs to be conducted except at the timing when the printed sheet P' is transported from the transporting section R13 to the transporting section R12 via the junction point G.

The above transportation timing will be described. In the time-chart shown in FIG. 3, each of the sheets in the container trays 5*a* and 5*b* is fed into the transporting section R11 with a predetermined interval, and then, transported in the transporting section R11 and the transporting section R12 with a constant transportation speed. When the sheet enters the transporting section R13 through the branch point B, the transportation speed of the sheet is lowered just before the secondary transfer position T. After the sheet passes the fixation position F with that transportation speed, the transportation speed of the sheet is further lowered and temporarily stopped just before the junction point G for timing adjustment. In this way, the timing when the sheet is transported from the transporting section R11 to the transporting section R12 through the junction point G and the timing when the sheet is transported from the transporting section R13 to the transporting section R12 through the junction point G are adjusted.

The timing of the sheet temporarily stopped just before the junction point G in the transporting section R13 is adjusted so that the sheet is transported at the timing other than the timing of the sheet transportation from the transporting section R11. In this way, for the sheet in the transporting section R13, timing adjustment by the transportation speed and the timing adjustment by the temporary stop before the merging are conducted. When the sheet is transported to the transporting section R12 from the junction point G at the predetermined timing, the sheet is given curl correction by the curl correcting portion 4*f*, and then, transported from the branch point B to the transporting section R16, and discharged out of the apparatus through the exit opening 1*a*. In more detail, in the transporting route from the fixation position F of the fixing device 4*e* to the exit opening 1*a*, heat supplied to the sheet at the fixation is released, and thereby the sheet is discharged from the exit opening 1*a* in the state where the temperature of the sheet is lowered.

(Reversed Discharge)

Figure 4:
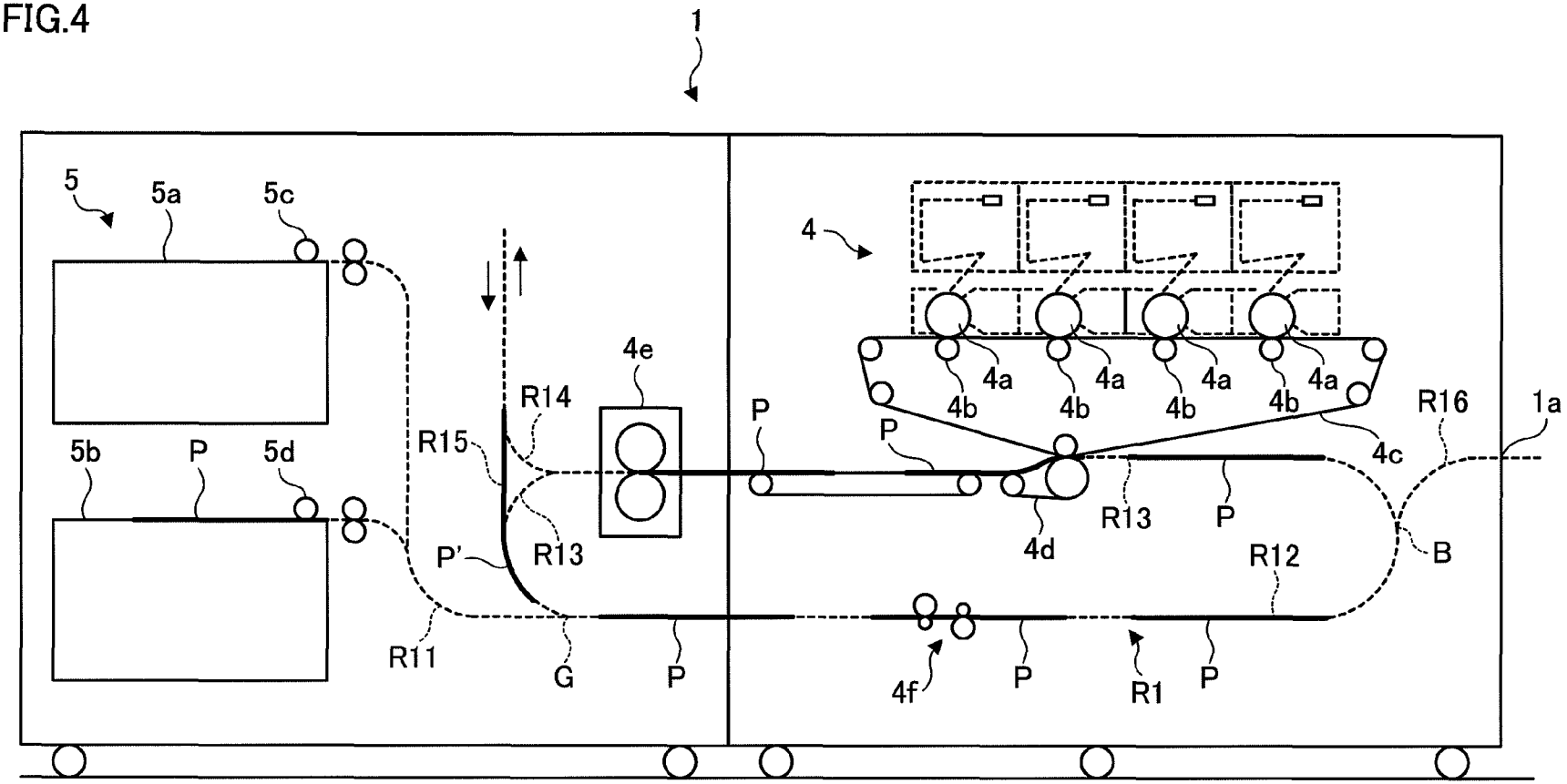
FIG. 4 is a diagram for explaining the sheet transportation in the transporting route in the case of the one-sided printing and the reversed discharge.
Figure 5:
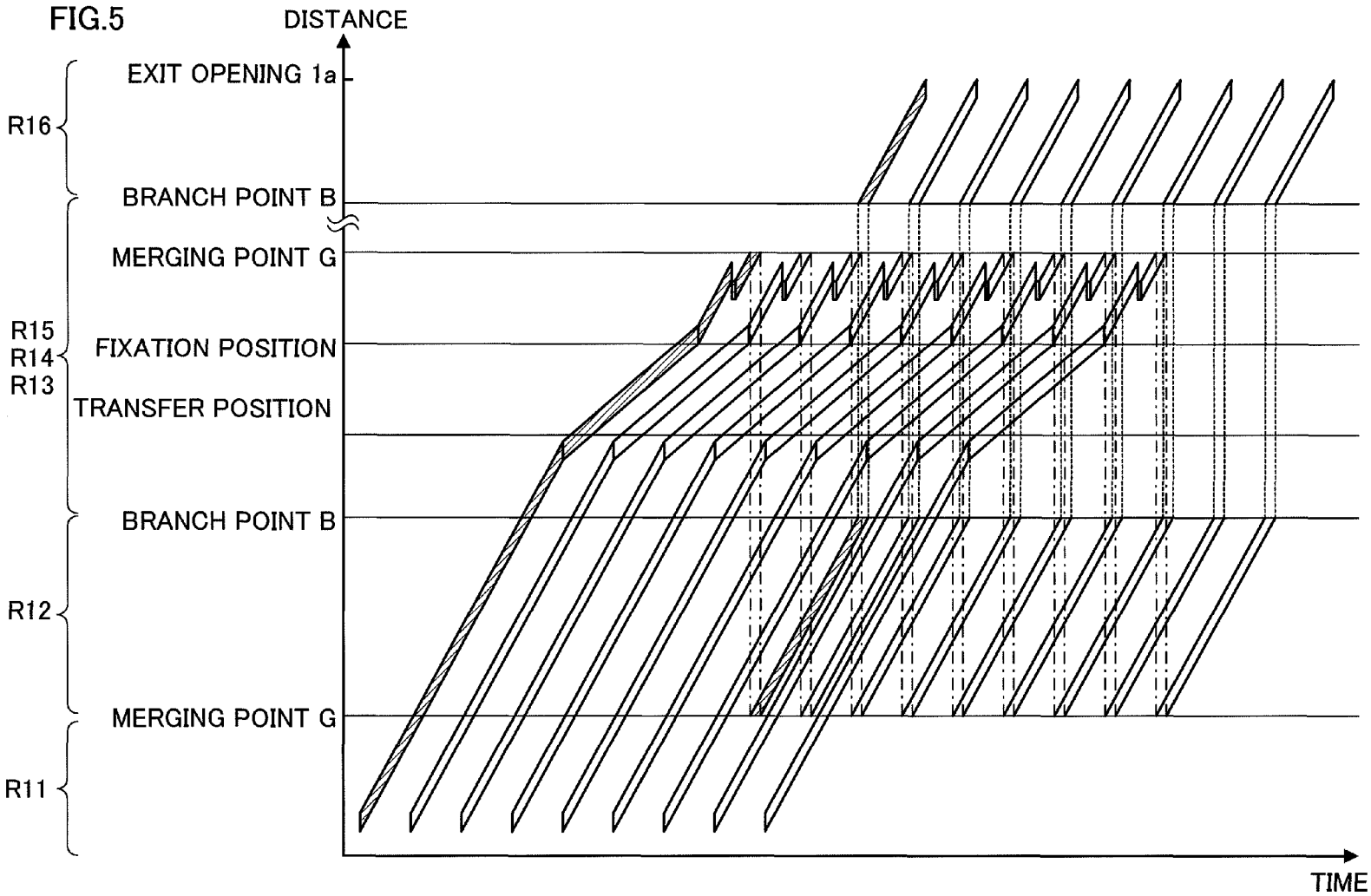
FIG. 5 is a time-chart of the sheet transportation in the transporting route in FIG. 4.

FIG. 4 is a diagram for explaining the sheet transportation in the transporting route R1 in the case of the one-sided printing and the reversed discharge, and FIG. 5 is a time-chart of the sheet transportation in the transporting route R1 in FIG. 4.

When a print instruction of the one-sided printing and the reversed discharge is given and the container tray 5*b* is selected, similarly to the sheet transportation shown in FIG. 2, the supplied sheet P is transported to the transporting section R13 through the transporting section R11, the junction point G, the transporting section R12 and the branch point B. In the transporting section R13, the supplied sheet P is subjected to the secondary transfer and the fixation.

After that, unlike the sheet transportation shown in FIG. 2, the printed sheet P' is transported to the transporting sections R14 and R15. That is, the printed sheet P' having passed the fixation position F is transported to the transporting sections R14 and R15, and then, is returned to the transporting section R13 in the state where the printed sheet P' is reversed. The printed sheet P' is transported from the transporting section R13 to the transporting section R12 via the junction point G, and then, transported to the transporting section R16 via the branch point B and discharged out of the apparatus from the exit opening 1*a*.

The transportation timing in the case of the reversed discharge will be described. In the time-chart shown in FIG. 5, each of the sheets in the container trays 5*a* and 5*b* is fed into the transporting section R11 with a predetermined interval and transported in the transporting section R11 and the transporting section R12 at a constant transport speed. When the sheet enters the transporting section R13 via the branch point B, the sheet is transported with a lower transport speed till the sheet passes the fixation position F from a position just before the transfer position T.

When the sheet is transported from the transporting section R13 to the transporting sections R14 and R15, the transportation is stopped once and the sheet is immediately transported in the opposite direction, and then, the transportation is stopped again and the sheet stands by till the transportation is started. The sheet transportation is resumed at predetermined timing other than the timing of the sheet transportation from the transporting section R11, the sheet is given the curl correction at the curl correcting portion 4*f*, and then, the sheet is transported from the branch point B to the transporting section R16 and discharged out of the apparatus through the exit opening 1*a*.

The timing when the sheet is transported from the transporting section R11 to the transporting section R12 through the junction point G and the timing when the sheet is transported from the transporting section R13 to the transporting section R12 through the junction point G are adjusted in a waiting time for reversing the sheet.

(Duplex Printing)

Figure 6:
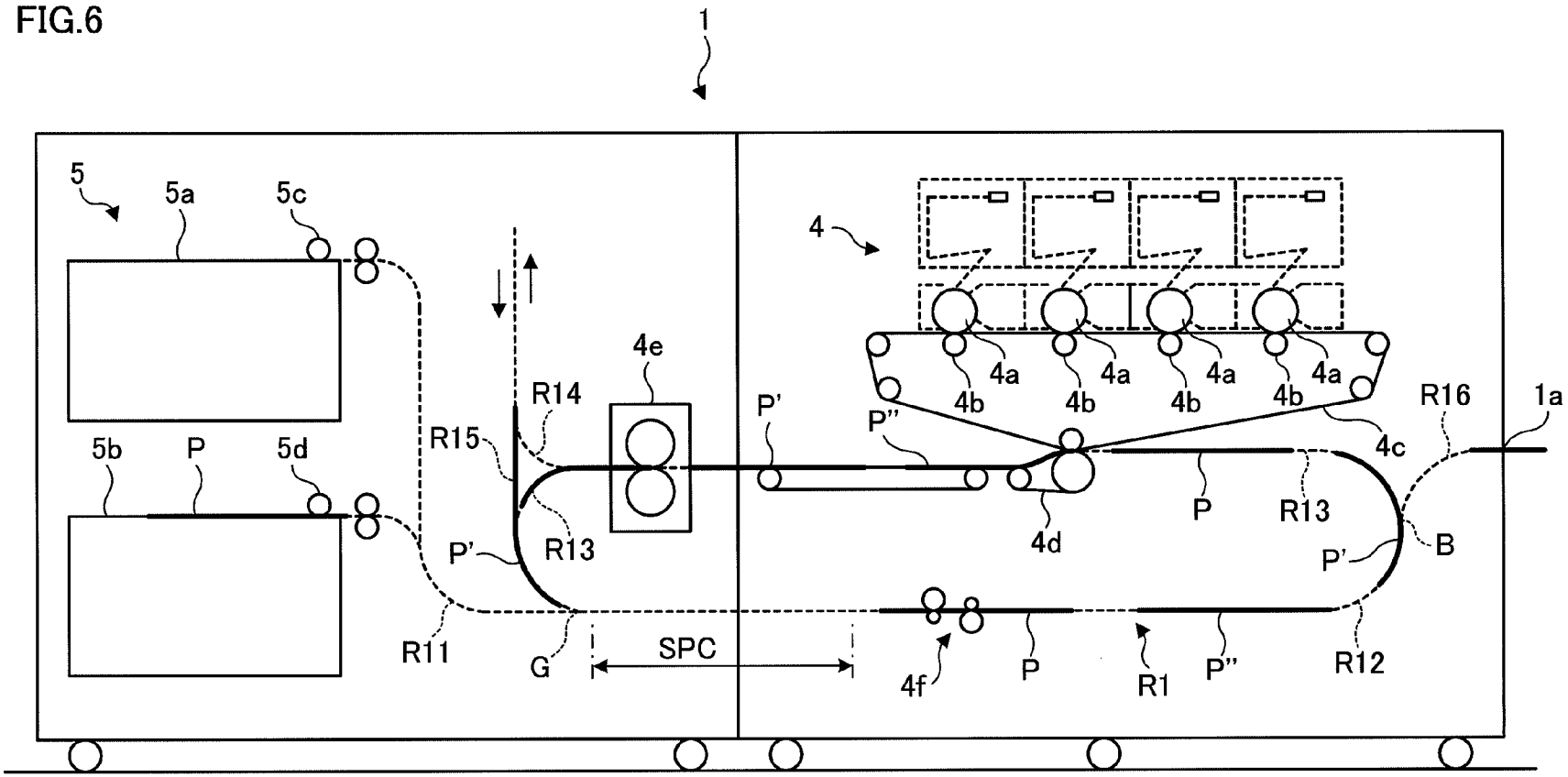
FIG. 6 is a diagram for explaining the sheet transportation in the transporting route in the case of the duplex printing.
Figure 7:
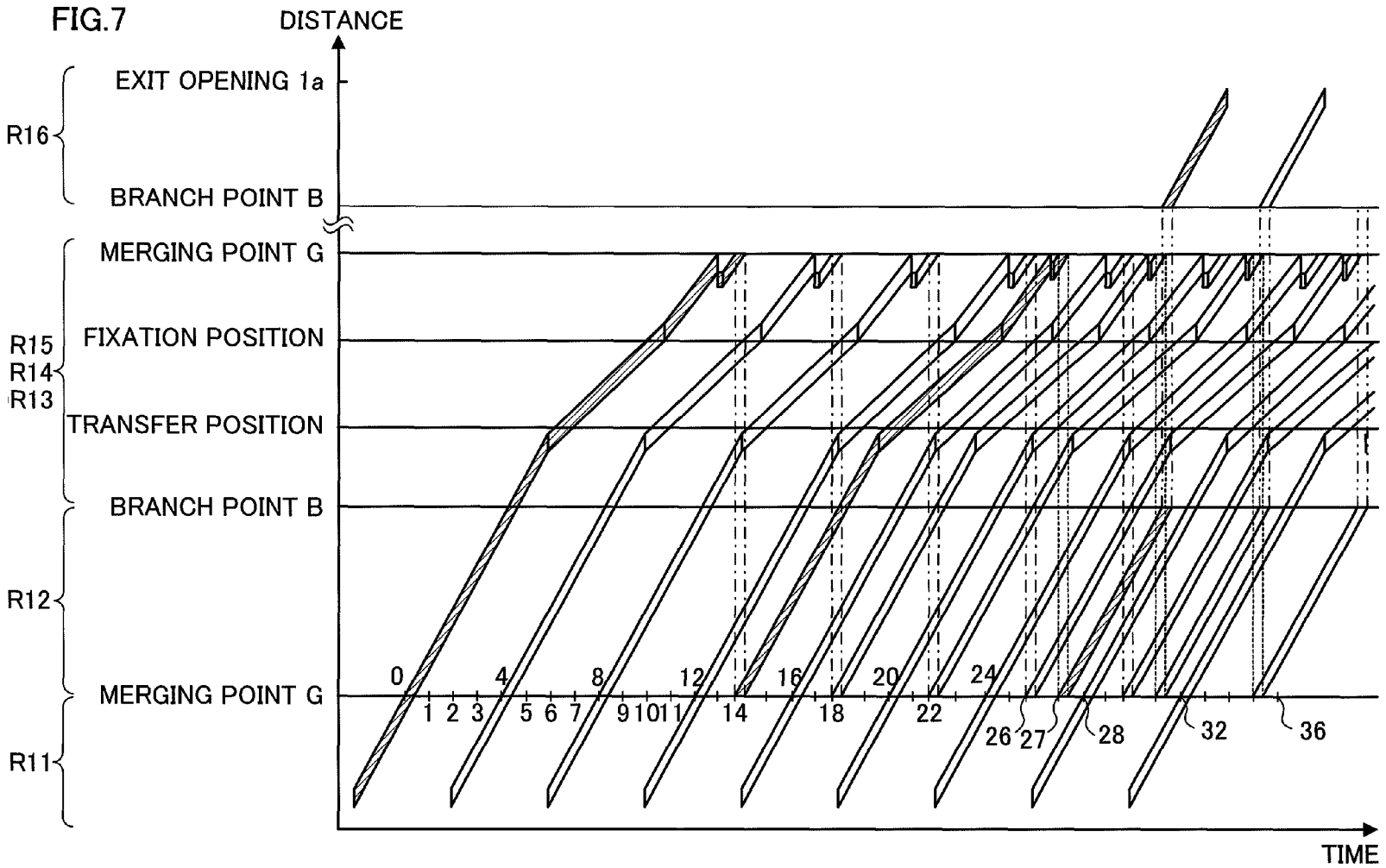
FIG. 7 is a time-chart of the sheet transportation in the transporting route in FIG. 6.

FIG. 6 is a diagram for explaining the sheet transportation in the transporting route R1 in the case of the duplex printing, and FIG. 7 is a time-chart of the sheet transportation in the transporting route R1 in FIG. 6. A scale given to a lateral line at the junction point G in FIG. 7 indicates synchronous signals and numbers thereof refer to serial numbers.

When a print instruction of the duplex printing is given and the container tray 5*b* is selected, similarly to the sheet transportation shown in FIG. 4, the supplied sheet P is transported to the transporting section R13 through the transporting section R11, the junction point G, the transporting section R12 and the branch point B. Then, the printed sheet P' subjected to the secondary transfer and the fixation on the surface thereof in the transporting section R13 is transported to the transporting sections R14 and R15, and returns to the transporting section R13 in the state where the printed sheet P' is reversed.

After that, the printed sheet P' returned to the transporting section R13 is transported to the transporting section R13 again via the junction point G, the transporting section R12, and the branch point B. The duplex printed sheet P" also subjected to the secondary transfer and the fixation on the back surface in the transporting section R13 is transported to the transporting section R16 via the junction point G, the transporting section R12, and the branch point B, and discharged out of the apparatus from the exit opening 1*a*.

The transportation timing in the case of the duplex printing will be described. In the time-chart shown in FIG. 7, a synchronous signal is generated at a time interval half of that in the case of the reversed discharge shown in FIG. 4 (double frequency). In addition, the sheet is transported so that the timing when the front end of the sheet passes the junction point G is synchronized with the synchronous signal.

In more detail, the sheets passing the junction point G include three types: the supplied sheet P from the transporting section R11 (refer to FIG. 6), the printed sheet P' subjected to the one-sided printing from the transporting section R12, and the duplex printed sheet P" subjected to the duplex printing from the transporting section R12. The supplied sheet P is fed into the transporting section R12 from the transporting section R11 via the junction point G in accordance with the synchronous signal of a multiple number of 4 (4×N). The printed sheet P' is fed into the transporting section R12 from the transfer section R13 via the junction point G in accordance with the synchronous signal of a number acquired by adding 2 to a multiple number of 4 (4×N+2). The duplex printed sheet P" is fed into the transporting section R12 from the transporting section R13 via the junction point G in accordance with the synchronous signal of a number acquired by adding 3 to a multiple number of 4 (4×N+3).

As mentioned above, the sheet transportation is controlled so that the front end of the sheet passes the junction point G in synchronization with the synchronous signal. The timing of the supplied sheet P is 4×N, the timing of the printed sheet P' is 4×N+2, the timing of the duplex printed sheet P" is 4×N+3, and nothing is applied for 4×N+1.

In the first exemplary embodiment, a mechanism for acceleration or deceleration, or a mechanism for standby is not disposed in the halfway of the transporting section R12. Accordingly, a gate (not shown in the figure) at the branch point B is controlled so that synchronous signals of even numbers are directed to the transporting section R13, while synchronous signals of odd numbers are directed to the transporting section R16. That is, at the branch point B, the gate (not shown in the figure) at the branch point B is controlled so that the case of transportation to the transporting section R13 and the case of transportation to the transporting section R16 are alternated.

More specifically, in the case of the image formation on both sides of the sheet, four pieces (N pieces) of the supplied sheet P are fed into the transporting section R11 consecutively from the container trays 5*a* and 5*b*. Each of the four supplied sheets P passes the junction point G at the timing of 4×N. Each of the four supplied sheets P is transported to the transporting sections R12 and R13, and then, printed on the front surface so that the printed sheet P' is formed.

Here, each of the four printed sheets P' is stands by in the state where each of the four printed sheets P' is reversed by using the transporting sections R14 and R15. Further, each of the four printed sheets P' skips one synchronous signal and passes the junction point G at the timing of 4×N+2. Each of the four printed sheets P' is subjected to printing for its back surface after being transported to the transporting sections R12 and R13, and the duplex printed sheet P" is formed. Since a single synchronous signal is skipped, as shown in FIG. 6, there is a portion with a space SPC for a single sheet.

Each of the four duplex printed sheets P" stands by just before the junction point G of the transporting section R13, and, after passing the junction point G at the timing of 4×N+3, is transported to the transporting section R16 via the transporting section R12 and the branch point B, and is discharged from the exit opening 1*a* to the outside of the apparatus. There may be such a configuration in which the duplex printed sheet P" is made to standby in the transporting sections R14 and R15 other than the standby just before the junction point G of the transporting section R13.

[Second Exemplary Embodiment]

Figure 8:
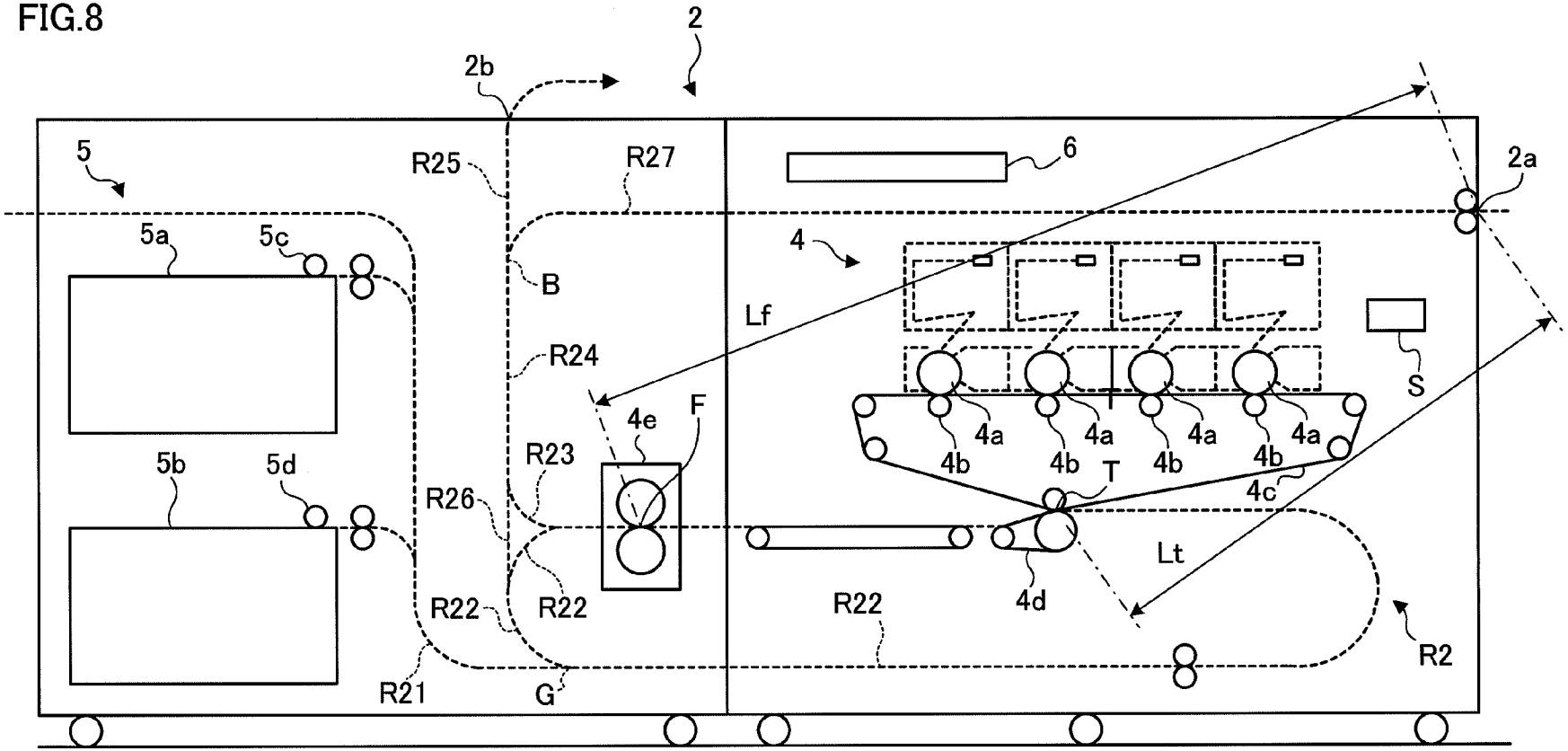
FIG. 8 is a schematic configuration diagram illustrating an entire configuration of an image forming apparatus according to the second exemplary embodiment.

FIG. 8 is a schematic configuration diagram illustrating an entire configuration of an image forming apparatus 2 according to the second exemplary embodiment.

The image forming apparatus 2 shown in FIG. 8 has a basic configuration common to that of the image forming apparatus 1 according to the first exemplary embodiment. That is, the image forming apparatus 2 is provided with the image forming unit 4, the sheet supplying unit 5, and the controller S. In more detail, there is a difference between the image forming apparatus 2 and the image forming apparatus 1, since a transporting section R27 for sheet discharge, which will be described later, is located on the upper part of the image forming unit 4 in the imaged forming apparatus 2 while a transporting section R16 is not located on an upper part of the image forming unit 4 in the image forming apparatus 1.

Since the image forming unit 4, the sheet supplying unit 5 and the controller S have the same configuration as those of the image forming apparatus 1, explanation of the respective specific configurations will be omitted. The same reference numerals are used in the explanation of the same configurations as those of the image forming apparatus 1.

In the image forming apparatus 2, an exit opening 2*a* corresponding to the exit opening 1*a* that discharges the printed sheets to the outside of the apparatus, and a purge sheet discharging portion 2*b* that discharges purge sheets to the outside of the apparatus are formed. Inside the image forming apparatus 2, the transporting route R2 that transports each of various types of sheets so that the sheet passes from the sheet supplying unit 5 to the image forming unit 4 is disposed. A tray (not shown in the figure) that contains the purge sheets discharged from the purge sheet discharging portion 2*b* is disposed on a top face of the apparatus.

In the image forming apparatus 2, a blowing unit 6 that cools the sheet discharged from the exit opening 2*a* of the transporting route R2 by air is disposed in the transporting section R27 of the transporting route R2, which will be described later.

The sheet supplying unit 5 is configured so that the sheet contained in another tray (not shown in the figure) may be selectively fed into a transporting section R21 of the transporting route R2, which will be described later.

Here, the transporting route R2 will be described below.

The transporting route R2 is provided with the transporting section R21 that transports each of the various types of sheets taken out from the container trays 5*a* and 5*b* to a junction point G, and a transporting section R22 that transports each of the various types of sheets so as to pass a secondary transfer position T and a fixation position F.

Further, the transporting route R2 is provided with a transporting section R23 branching from the transporting section R22 on the downstream side of the fixation position F of the transporting section R22 and extending in an arc state, a transporting section R24 continuing to the transporting section R23 and extending upward to the branch point B, and a transporting section R25 further extending upward from the branch point B and extending to the purge sheet discharging portion 2*b*.

Furthermore, the transporting route R2 is provided with the transporting section R26 that connects a position just before the junction point G in the transporting section R22 and the lower end of the transporting section R24 each other, and the transporting section R27 extending from the branch point B to the exit opening 2*a* in the lateral direction.

In more detail, the transporting section R26 is provided in order to reverse each of the various types of sheets during the transportation and transport the sheet to the transporting section R24. That is, when each of the various types of sheets transported in the transporting section R22 is fed into the transporting section R22 again, via the junction point G, the transportation is stopped once. Each of the various types of sheets is then, transported in a direction opposite to the direction where the sheet has been transported and further sequentially transported to the transporting section R24, the branch point B and the transporting section R27 via the junction point G and the transporting section R26. Thereby, each of various types of sheets is reversed and discharged.

The transporting section R26 is provided also for reversing each of the various types of sheets being transported and for returning it to the transporting section R22. That is, when each of the various types of sheets transported in the transporting section R22 is fed into the transporting section R25 from the transporting section R23 via the transporting section R24, the transportation is stopped once. Then, each of the various types of sheets is transported in a direction (downward) opposite to the direction (upward) having been transported so far and returned to the position just before the junction point G of the transporting section R22 from the transporting section R25 via the transporting section R24 and the transporting section R26. In this state, when the sheet is fed into the transporting section R22 again via the junction point G, transfer and fixation is conducted on a surface on which the transfer and the fixation has not been conducted yet. In addition, in the transporting route R2 in the second exemplary embodiment, a section exclusively for reversing the sheet is not provided, and a section that transports the sheet is also used as the section for reversing the sheet. In this point, this route is different from the transporting route R1 in the first exemplary embodiment.

The sheet fed into the transporting section R25 from the transporting section R22 via the transporting section R23 may be discharged to the purge sheet discharging portion 2*b* as it is, instead of reversed.

The junction point G is a downstream end of the transporting section R21, and is also an upstream end and a downstream end of the transporting section R22. That is, the transporting section R22 constitutes a circulation transporting route including the junction point G. The branch point B is a downstream end of the transporting section R24, an upstream end of the transporting section R27, and a lower end of the transporting section R25.

The sheet is transported so as to be circulated in the transporting section R22 and also may be transported so as to be circulated in the transporting sections R22, R23, R24, R25 and R26 while alternately reversed in the transportation. Moreover, the sheet transported to the branch point B is transported to the exit opening 2*a* through the transporting section R27 and also may be transported to the purge sheet discharging portion 2*b* through the transporting section R25.

In the image forming apparatus 2, the one-sided printing and the duplex printing may be conducted similarly to the image forming apparatus 1 according to the first exemplary embodiment, and the reversed discharge may be also conducted. The normal discharge in the one-sided printing, the reversed discharge in the one-sided printing and the duplex printing will be described below separately.

(Regular Discharge)

Figure 9:
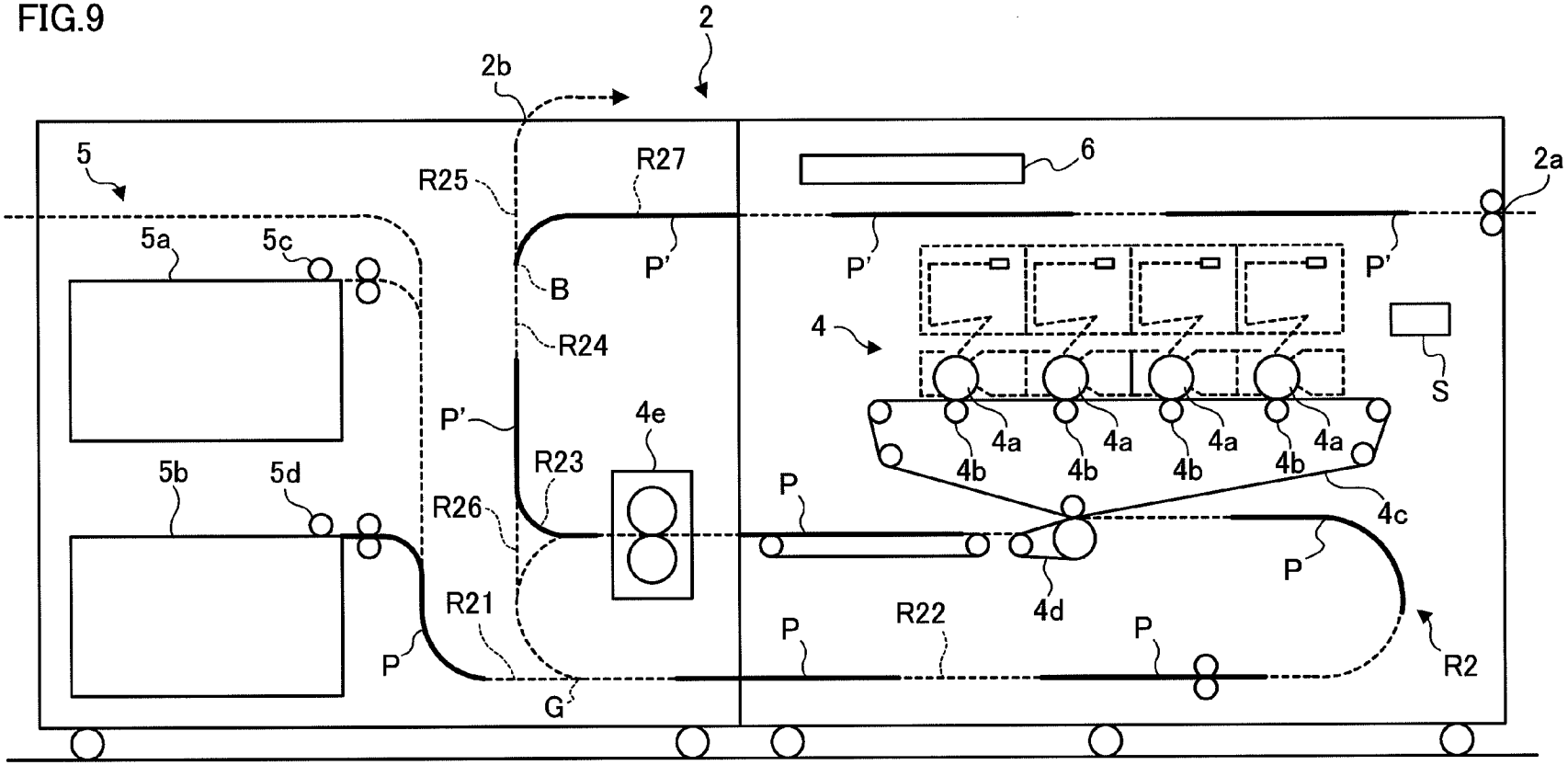
FIG. 9 is a diagram for explaining the sheet transportation in the transporting route in the case of one-sided printing.

FIG. 9 is a diagram for explaining the sheet transportation in the transporting route R2 in the case of one-sided printing.

When a print instruction of the one-sided printing is given and the container tray 5*b* is selected, as shown in FIG. 9, a supplied sheet P fed out of the container tray 5*b* to the transporting section R21 by the feeding roll 5*d* is transported to the transporting section R22 through the junction point G. In the transporting section R22, the toner image is transferred to the supplied sheet P at the secondary transfer position T (refer to FIG. 8) and the toner image is fixed at the fixation position F (refer to FIG. 8). A printed sheet P' having passed the fixation position F is transported from the transporting section R22 to the transporting section R23 and the transporting section R24, and then, transported to the transporting section R27 via the branch point B. In the transporting section R27, the printed sheet P' is cooled by a blowing unit 6 with air, and discharged out of the apparatus from the exit opening 2*a*.

(Reversed Discharge)

Figure 10:
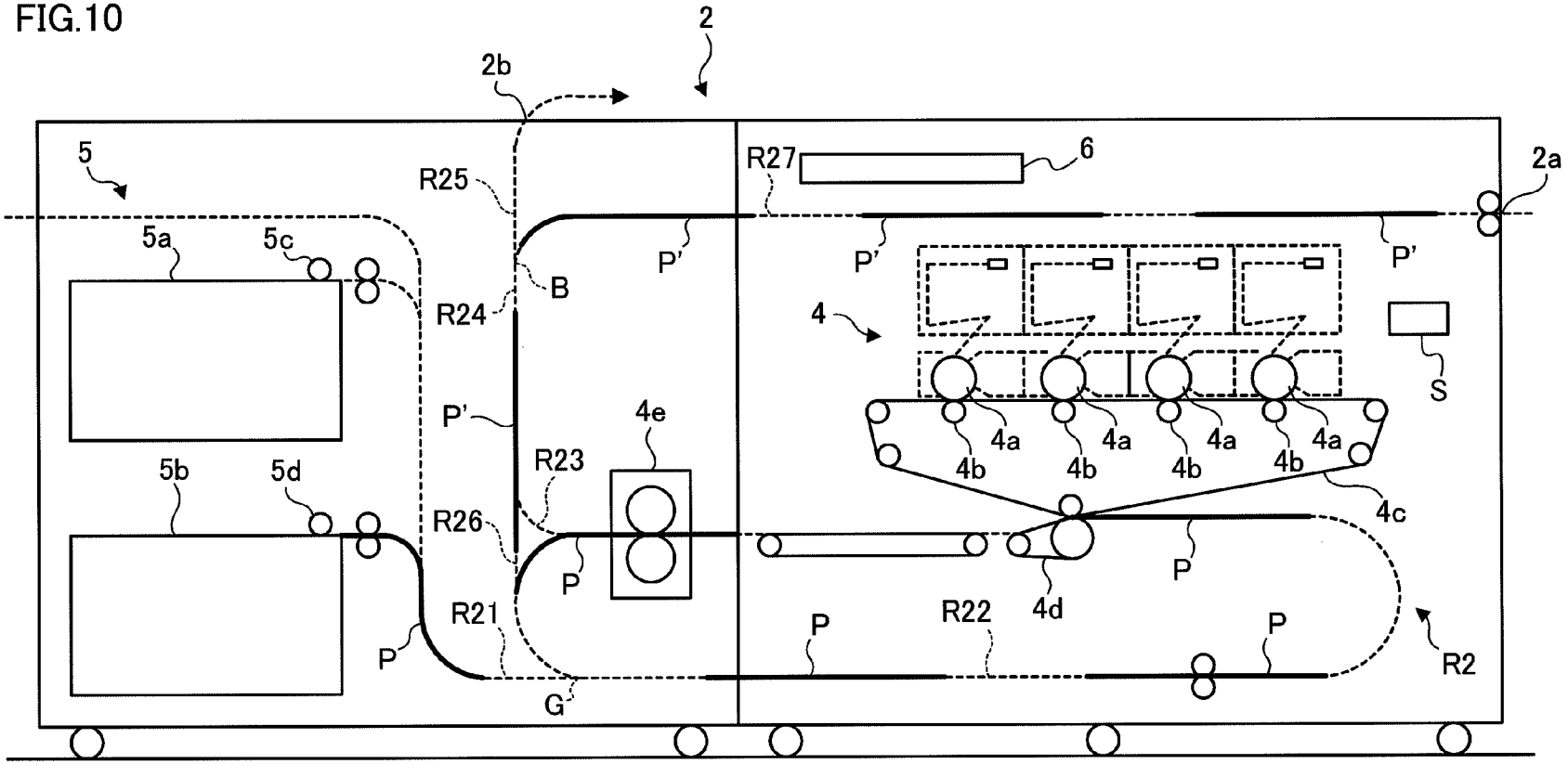
FIG. 10 is a diagram for explaining the sheet transportation in the transporting route in the case of the one-sided printing and the reversed discharge.

FIG. 10 is a diagram for explaining the sheet transportation in the transporting route R2 in the case of the one-sided printing and the reversed discharge.

When a print instruction of the one-sided printing and the reversed discharge is given and the container tray 5*b* is selected, the supplied sheet P is transported to the transporting section R22 through the transporting section R21 and the junction point G. In the transporting section R22, the supplied sheet P is subjected to the secondary transfer and the fixation.

The printed sheet P' subjected to the secondary transfer and the fixation is transported from the transporting section R22 to the transporting section R22 again via the junction point G, and then, is sequentially transported to the junction point G, the transporting section R26, the transporting section R24, the branch point B and the transporting section R27 in the state where the printed sheet P' is reversed. In the transporting section R27, the printed sheet P' is cooled by a blowing unit 6 with air, and discharged out of the apparatus from the exit opening 2*a*.

(Duplex Printing)

Figure 11:
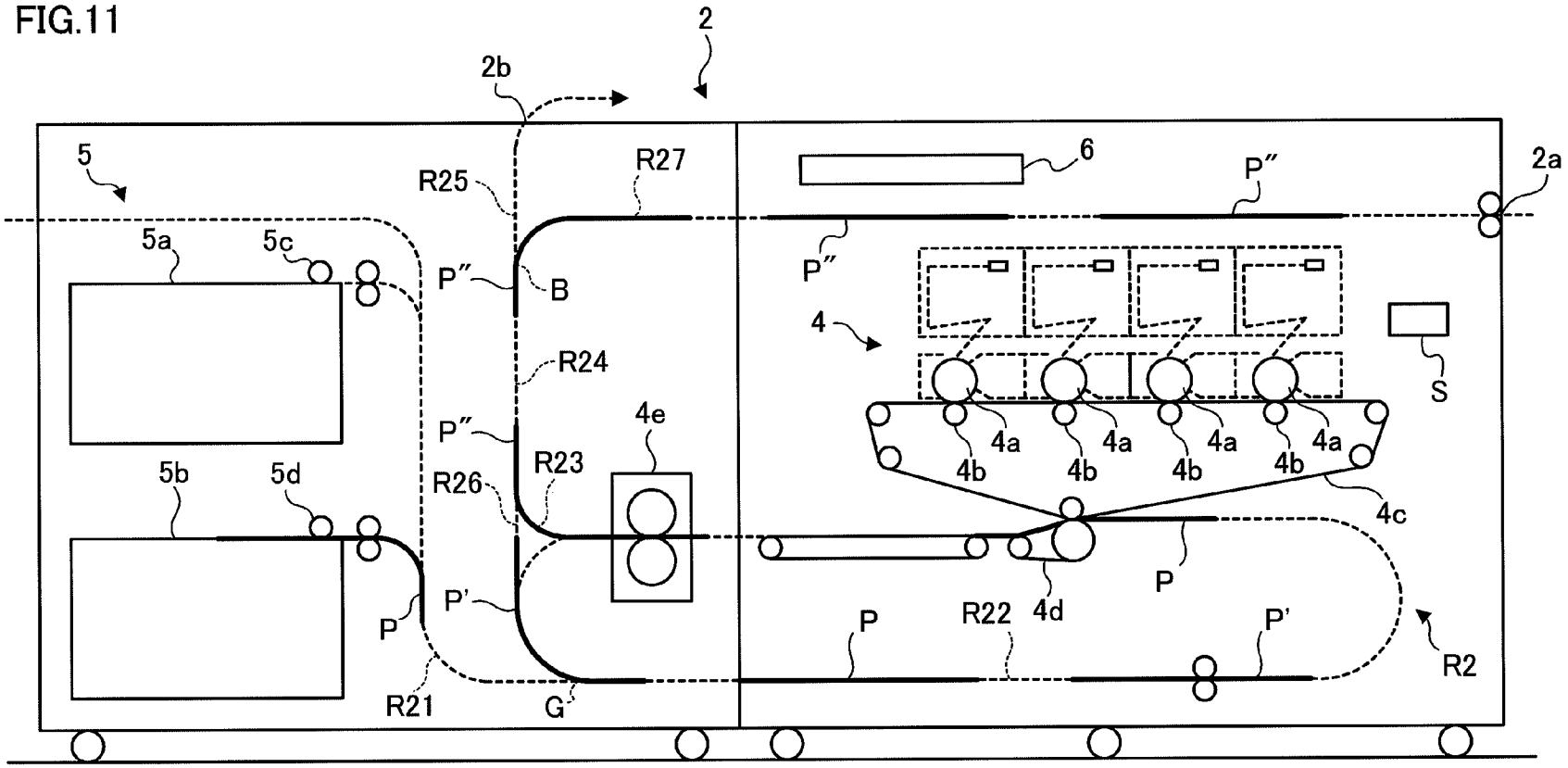
FIG. 11 is a diagram for explaining the sheet transportation in the transporting route in the case of the duplex printing.

FIG. 11 is a diagram for explaining the sheet transportation in the transporting route R2 in the case of the duplex printing.

When a print instruction of the duplex printing is given and the container tray 5*b* is selected, the supplied sheet P is transported to the transporting section R22 through the transporting section R21 and the junction point G. In the transporting section R22, the supplied sheet P is subjected to the secondary transfer and the fixation for the surface.

The printed sheet P' subjected to the secondary transfer and the fixation for the surface is transported to the transporting section R25 through the transporting section R23 and the transporting section R24. In the transporting section R25, the printed sheet P' is stopped once and then is transported in the opposite direction (downward) at the predetermined timing, and is transported to the transporting section R22 via the junction point G after being transported to the transporting section R24 and the transporting section R26. In the transporting section R22, the printed sheet P' is subjected to the secondary transfer and the fixation for the back surface.

The duplex printed sheet P" subjected to the secondary transfer and the fixation for both surfaces is transported to the transporting section R27 via the branch point B after being transported to the transporting section R23 and the transporting section R24. In the transporting section R27, duplex printed sheet P" is cooled by the blowing unit 6 with air, and then the duplex printed sheet P" is discharged from the exit opening 2*a* to the outside of the apparatus.

[Third Exemplary Embodiment]

Figure 12:
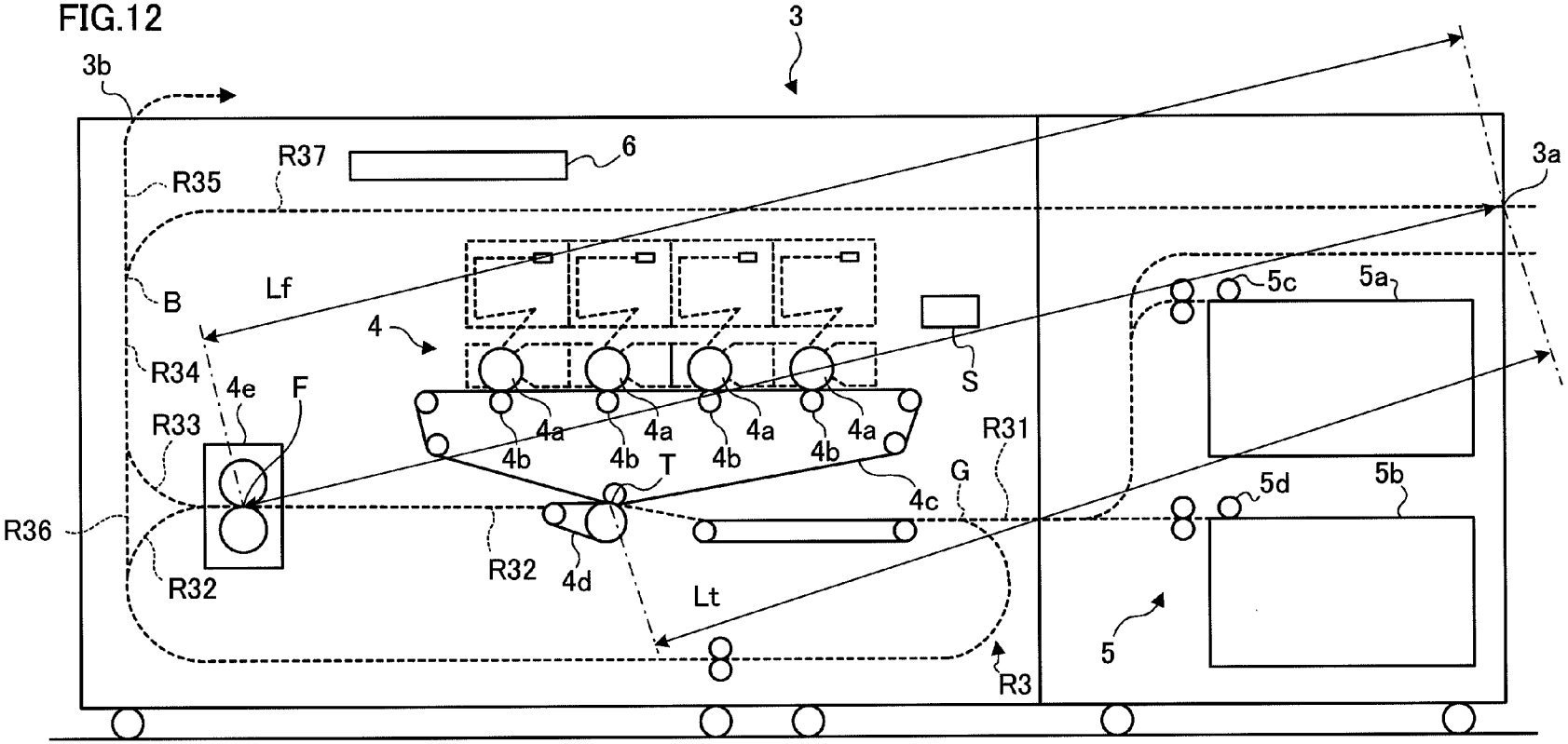
FIG. 12 is a schematic configuration diagram illustrating an entire configuration of an image forming apparatus according to the third exemplary embodiment.

FIG. 12 is a schematic configuration diagram illustrating an entire configuration of an image forming apparatus 3 according to the third exemplary embodiment.

The image forming apparatus 3 shown in FIG. 12 has a basic configuration common to that of the image forming apparatus 2 according to the second exemplary embodiment. That is, the image forming apparatus 3 is provided with the image forming unit 4, the sheet supplying unit 5, and the controller S. In more detail, there is a difference between the image forming apparatus 3 and the image forming apparatus 2, since a paper supplying unit 5 is arranged on the side of the sheet discharge with respect to the image forming unit 4 in the image forming apparatus 3 while the paper supplying unit 5 is arranged on the opposite side of the sheet discharge with respect to the image forming unit 4 in the image forming apparatus 2.

Since the image forming unit 4, the sheet supplying unit 5 and the controller S have the same configuration as those of the image forming apparatus 2, explanation of the respective specific configurations will be omitted. The same reference numerals are used in the explanation of the same configurations as those of the image forming apparatus 2.

In the image forming apparatus 3, an exit opening 3*a* corresponding to the exit opening 2*a* that discharges the printed sheets to the outside of the apparatus, and a purge sheet discharging portion 3*b* corresponding to the purge sheet discharging portion 2*b* that discharges purge sheets to the outside of the apparatus are formed. Inside the image forming apparatus 3, the transporting route R3 that transports each of various types of sheets so that the sheet passes from the sheet supplying unit 5 to the image forming unit 4 is disposed.

Here, the transporting route R3 will be described below.

The transporting route R3 is provided with a transporting section R31 that transports each of the various types of sheets taken out from the container trays 5*a* and 5*b* to a junction point G, and a transporting section R32 that transports each of the various types of sheets so as to pass a secondary transfer position T and a fixation position F.

Further, the transporting route R3 is provided with a transporting section R33 branching from the transporting section R32 on the downstream side of the fixation position F of the transporting section R32 and extending in an arc state, a transporting section R34 continuing to the transporting section R33 and extending upward to the branch point B, and a transporting section R35 further extending upward from the branch point B and extending to the purge sheet discharging portion 3*b*.

Furthermore, the transporting route R3 is provided with a transporting section R36 that connects a position opposite to the junction point G in the transporting section R32 and the lower end of the transporting section R34 each other, and a transporting section R37 extending from the branch point B to the exit opening 3*a* in the lateral direction.

Here, the transporting sections R31, R32, R33, R34, R35, R36 and R37 of the transporting route R3 correspond to the transporting sections R21, R22, R23, R24, R25, R26 and R27 of the transporting route R2, respectively. Thus, a description of the transporting sections R31, R32, R33, R34, R35, R36 and R37 is omitted.

(Regular Discharge)

Figure 13:
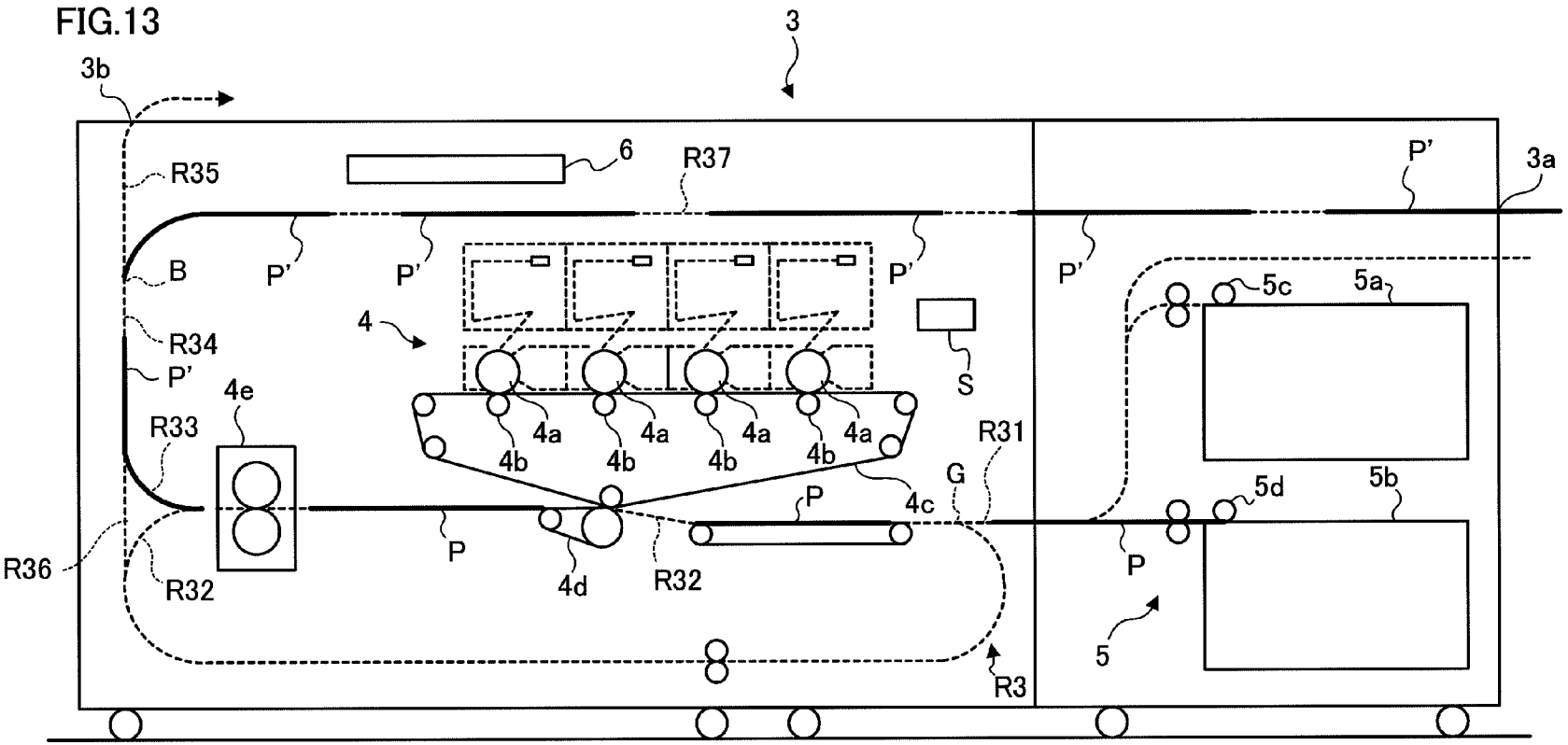
FIG. 13 is a diagram for explaining the sheet transportation in the transporting route in the case of one-sided printing.

FIG. 13 is a diagram for explaining the sheet transportation in the transporting route R3 in the case of one-sided printing.

When a print instruction of the one-sided printing is given and the container tray 5*b* is selected, as shown in FIG. 13, a supplied sheet P fed out of the container tray 5*b* to the transporting section R31 by the feeding roll 5*d* is transported to the transporting section R32 through the junction point G. In the transporting section R32, the toner image is transferred to the supplied sheet P at the secondary transfer position T (refer to FIG. 12) and the toner image is fixed at the fixation position F (refer to FIG. 12). A printed sheet P' having passed the fixation position F is transported from the transporting section R32 to the transporting section R33 and the transporting section R34, and then, transported to the transporting section R37 via the branch point B. In the transporting section R37, the printed sheet P' is cooled by a blowing unit 6 with air, and discharged out of the apparatus from the exit opening 3*a*.

(Reversed Discharge)

Figure 14:
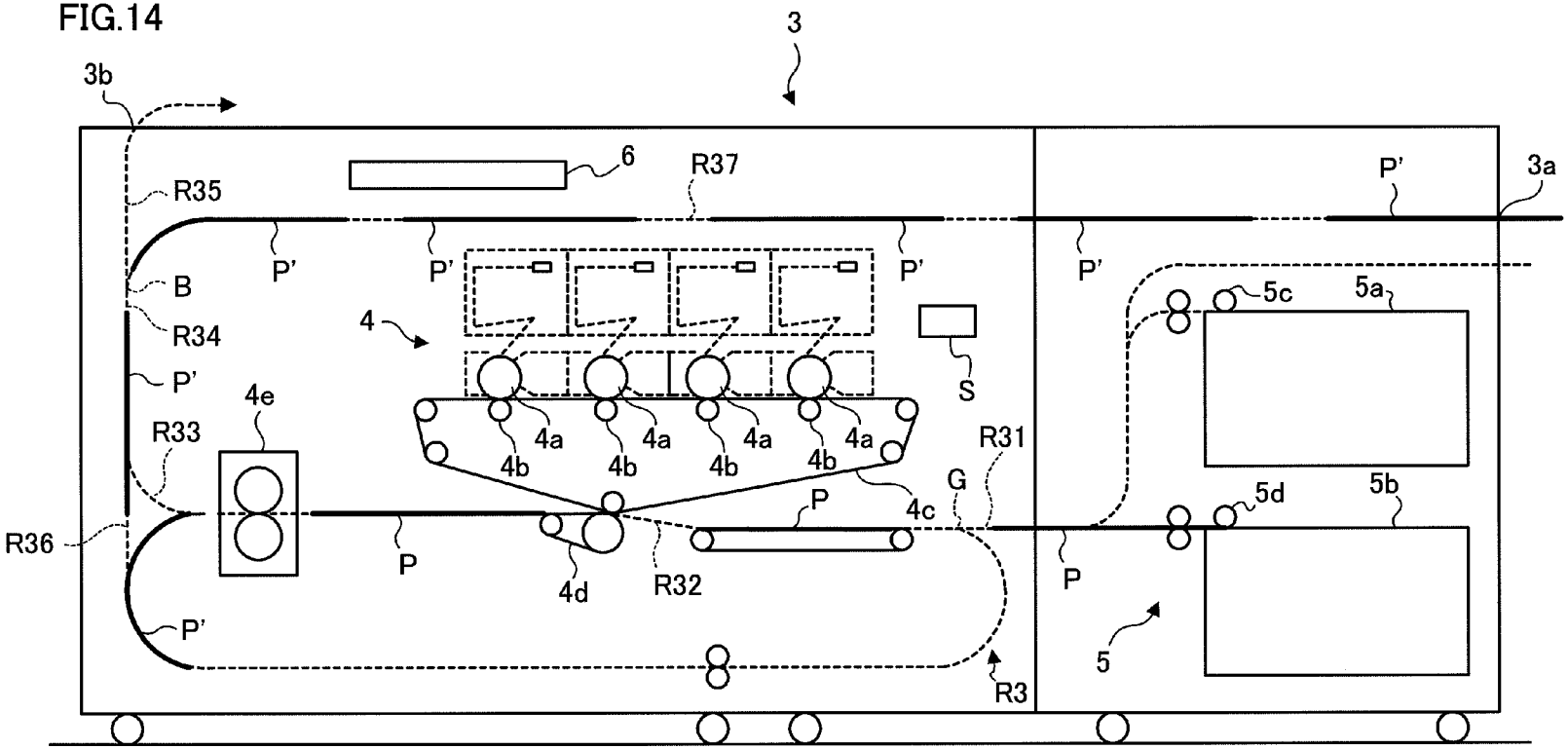
FIG. 14 is a diagram for explaining the sheet transportation in the transporting route in the case of the one-sided printing and the reversed discharge.

FIG. 14 is a diagram for explaining the sheet transportation in the transporting route R3 in the case of the one-sided printing and the reversed discharge.

When a print instruction of the one-sided printing and the reversed discharge is given and the container tray 5*b* is selected, the supplied sheet P is transported to the transporting section R32 through the transporting section R31 and the junction point G. In the transporting section R32, the supplied sheet P is subjected to the secondary transfer and the fixation.

The printed sheet P' subjected to the secondary transfer and the fixation is stopped once. After that, the printed sheet P' is transported in the opposite direction at the predetermined timing, and is sequentially transported to the transporting section R36, the transporting section R34, the branch point B and the transporting section R37. In the transporting section R37, the printed sheet P' is cooled by a blowing unit 6 with air, and discharged out of the apparatus from the exit opening 3*a*.

(Duplex Printing)

Figure 15:
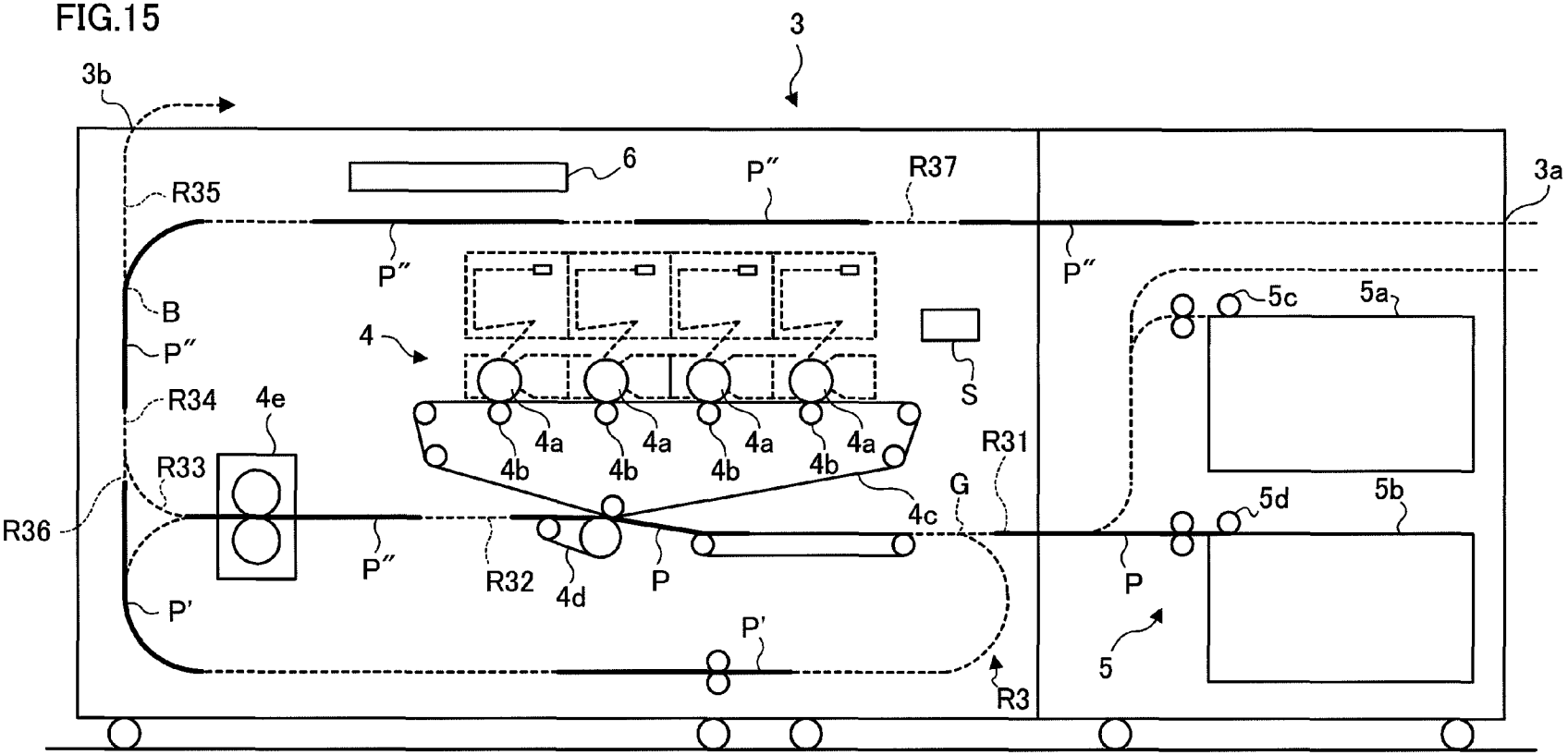
FIG. 15 is a diagram for explaining the sheet transportation in the transporting route in the case of the duplex printing.

FIG. 15 is a diagram for explaining the sheet transportation in the transporting route R3 in the case of the duplex printing.

When a print instruction of the duplex printing is given and the container tray 5*b* is selected, the supplied sheet P is transported to the transporting section R32 through the transporting section R31 and the junction point G. In the transporting section R32, the supplied sheet P is subjected to the secondary transfer and the fixation for the surface.

The printed sheet P' subjected to the secondary transfer and the fixation for the surface is transported to the transporting section R35 through the transporting section R33 and the transporting section R34. In the transporting section R35, the printed sheet P' is stopped once, is transported in the opposite direction (downward) at the predetermined timing, and is transported to the transporting section R32 via the junction point G after transported to the transporting sections R34 and R36. Then, in the transporting section R32, the printed sheet P' is subjected to the secondary transfer and the fixation for the back surface.

The duplex printed sheet P" subjected to the secondary transfer and the fixation for the both surfaces is transported to the transporting section R37 via the branch point B after transported to the transporting section R33 and the transporting section R34. In the transporting section R37, the duplex printed sheet P" is cooled by the blowing unit 6 with air, and then the duplex printed sheet P" is discharged from the exit opening 3*a* to the outside of the apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a carrier that carries a toner image;

a transporting unit that transports a sheet along a transporting route;

a transfer unit that transfers the toner image carried by the carrier to the sheet transported by the transporting unit;

a fixing unit that fixes the toner image transferred by the transfer unit on the sheet; and an exit opening at which the sheet is discharged from the image forming apparatus, wherein the transporting route comprises a first transporting section in which the sheet is transported from a sheet source to a junction point, a second transporting section in which the sheet is transported from the junction point to a branch point at which the transporting route branches in a first direction to the transfer unit and in a second direction to the exit opening, a third transporting section in which the sheet is transported from the branch point in the first direction through a transfer position of the transfer unit and a fixing position of the fixing unit to the junction point, and a fourth transporting section in which the sheet is transported from the branch point in the second direction to the exit opening, and wherein a distance between a position of the exit opening and the transfer position of the transfer unit is less than a distance between the position of the exit opening and the fixing position of the fixing unit.

2. The image forming apparatus according to claim 1, wherein the transporting unit has a circulation transporting route in which the sheet is transported so as to be circulated in a case of duplex printing.

3. The image forming apparatus according to claim 2, further comprising a correction portion that is disposed in the second transporting section and that corrects a curling of the sheet.

4. An image forming apparatus comprising:

a carrier that carries a toner image;

a transporting unit that transports a sheet along a transporting route;

a transfer unit that transfers the toner image carried by the carrier to the sheet transported by the transporting unit;

a fixing unit that fixes the toner image transferred by the transfer unit on the sheet; and an exit opening that discharges the sheet on which the toner image is fixed by the fixing unit to an outside of the image forming apparatus, wherein the transporting route comprises a first transporting section in which the sheet is transported from a sheet source to a junction point, a second transporting section in which the sheet is transported from the junction point to a branch point at which the transporting route branches in a first direction to the transfer unit and in a second direction to the exit opening, a third transporting section in which the sheet is transported from the branch point in the first direction through a transfer position of the transfer unit and a fixing position of the fixing unit to the junction point, and a fourth transporting section in which the sheet is transported from the branch point in the second direction to the exit opening, and wherein a distance between the fixing position of the fixing unit and a position of the exit opening is longer than a distance between the transfer position of the transfer unit and the position of the exit opening in a case where the apparatus is seen from a transverse direction of the transporting route.

5. The image forming apparatus according to claim 4, further comprising a tray as the sheet source that contains the sheet, wherein the fixing unit is disposed between the tray and the transfer unit.

6. The image forming apparatus according to claim 4, further comprising another exit opening that discharges a sheet distinguished from the sheet discharged from the exit opening, wherein the another exit opening is formed in a top face of the apparatus.

7. An image forming apparatus comprising:

a carrier that carries a toner image;

a tray in which a sheet is contained;

a transfer unit that transfers the toner image carried by the carrier to the sheet supplied from the tray;

a transporting unit that transports the sheet to which the toner image is transferred by the transfer unit along a transporting route in a direction moving away from an exit opening that discharges the sheet to an outside of the apparatus; and a fixing unit that fixes the toner image transferred to the sheet transported by the transporting unit on the sheet, wherein the transporting route comprises a first transporting section in which the sheet is transported from the tray to a junction point, a second transporting section in which the sheet is transported from the junction point to a branch point at which the transporting route branches in a first direction to the transfer unit and in a second direction to the exit opening, a third transporting section in which the sheet is transported from the branch point in the first direction through a transfer position of the transfer unit and a fixing position of the fixing unit to the junction point, and a fourth transporting section in which the sheet is transported from the branch point in the second direction to the exit opening.

8. The image forming apparatus according to claim 7, wherein the transporting unit has a circulation transporting route in which the sheet is transported so as to be circulated in a case of duplex printing.

9. The image forming apparatus according to claim 8, further comprising a correction portion that is disposed in the second transporting section and that corrects a curling of the sheet.

10. An image forming method that forms an image on a sheet, comprising:

carrying a toner image on a carrier;

supplying a sheet contained in a tray from the tray along a first transporting section of a transporting route to a junction point and a second transporting section of the transporting route in which the sheet is transported from the junction point to a branch point at which the transporting route branches in a first direction to a transfer unit and in a second direction to an exit opening;

transferring by the transfer unit the toner image carried by the carrier to the sheet supplied from the junction point in the first direction;

transporting the sheet to which the toner image is transferred by the transfer unit along a third transporting section of the transporting route in a direction moving away from the exit opening that discharges the sheet to an outside of the apparatus;

fixing the toner image transferred to the transported sheet by a fixing unit; and transporting the sheet toward the exit opening after the fixing by the fixing unit along a fourth transporting section of the transporting route in the second direction and discharging the sheet from the exit opening.

11. The image forming method according to claim 10, wherein the sheet is transported along the third transporting section of the transporting route from the transfer unit toward the fixing unit in the direction moving away from the exit opening before the toner image transferred to the sheet by the transfer unit is fixed on the sheet by the fixing unit.

* * * * *